US010578113B2

(12) United States Patent
Lee

(10) Patent No.: US 10,578,113 B2
(45) Date of Patent: Mar. 3, 2020

(54) COOLANT PUMP AND COOLING SYSTEM PROVIDED WITH THE SAME FOR VEHICLE

(71) Applicants: Hyundai Motor Company, Seoul (KR); Kia Motors Corporation, Seoul (KR)

(72) Inventor: Hyo Jo Lee, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/018,744

(22) Filed: Jun. 26, 2018

(65) Prior Publication Data

US 2019/0186497 A1 Jun. 20, 2019

(30) Foreign Application Priority Data

Dec. 18, 2017 (KR) ..... 10-2017-0174559

(51) Int. Cl.

| | |
|---|---|
| ***F04D 27/00*** | (2006.01) |
| ***F01P 3/02*** | (2006.01) |
| ***F04D 13/02*** | (2006.01) |
| ***F01P 7/14*** | (2006.01) |
| ***F01P 5/12*** | (2006.01) |
| ***F04D 15/00*** | (2006.01) |

(52) U.S. Cl.

CPC ..... *F04D 27/003* (2013.01); *F01P 3/02* (2013.01); *F01P 5/12* (2013.01); *F01P 7/14* (2013.01); *F04D 13/021* (2013.01); *F04D 15/0038* (2013.01); *F01P 2007/146* (2013.01)

(58) Field of Classification Search

CPC . F01P 5/10; F01P 5/12; F04D 15/0038; F04D 29/026; F04D 29/049; F04D 29/061; F04D 29/106; F04D 29/126; F04D 29/586

See application file for complete search history.

(56) References Cited

U.S. PATENT DOCUMENTS

| | | | | |
|---|---|---|---|---|
| 2009/0038563 | A1* | 2/2009 | Takarai | F01P 7/164 123/41.02 |
| 2011/0162597 | A1* | 7/2011 | Draheim | F04D 15/0038 123/41.44 |
| 2012/0291724 | A1* | 11/2012 | Popp | F04D 15/0038 123/41.08 |
| 2014/0212267 | A1* | 7/2014 | Pawellek | F01P 7/161 415/26 |
| 2016/0215679 | A1* | 7/2016 | Pawellek | F04D 13/02 |

* cited by examiner

*Primary Examiner* — Long T Tran
(74) *Attorney, Agent, or Firm* — Morgan, Lewis & Bockius LLP

(57) ABSTRACT

A coolant pump for a vehicle may include an impeller mounted at one side of a shaft and pumping a coolant; a pulley mounted at the other side of the shaft and receiving a torque; a coolant pump housing including an inlet to which the coolant inflows and a discharge port formed in a vertical to the shaft; a slider disposed to be movable in a longitudinal direction of the shaft to selectively block or open the discharge port; and a driver moving the slider, wherein a fine passage that the coolant is expelled to the discharge port is formed at the slider.

18 Claims, 8 Drawing Sheets

COOLANT PUMP AND COOLING SYSTEM PROVIDED WITH THE SAME FOR VEHICLE

CROSS-REFERENCE TO RELATED APPLICATION

The present application claims priority to Korean Patent Application No. 10-2017-0174559 filed on Dec. 18, 2017, the entire contents of which is incorporated herein for all purposes by this reference.

BACKGROUND OF THE INVENTION

Field of the Invention

The present invention relates to a coolant pump and a cooling system including the same for a vehicle reducing a warm-up time of an engine and preventing a thermal shock by respectively controlling a coolant supplied to a cylinder block and a cylinder heady according to a driving condition.

Description of Related Art

An engine discharges thermal energy to an outside while generating torque based on combustion of a fuel. A coolant absorbs thermal energy while circulating through an engine, etc. and releases the thermal energy to an outside through a radiator, etc.

When a temperature of the coolant of the engine is low, viscosity of oil may increase to increase frictional force and fuel consumption, and a temperature of an exhaust gas may increase gradually to lengthen a time for a catalyst to be activated. Also, a quality of an exhaust gas may be deteriorated, and as a time required for a function of the heater to be normalized is increased, a driver may be in discomfort.

When the coolant temperature is excessively high, since knocking occurs, performance of the engine may deteriorate by adjusting ignition timing to suppress the knocking. Further, when a temperature of lubricant is excessively high, a viscosity is lowered such that a lubrication performance may be deteriorated.

Therefore, a coolant control valve to control several cooling elements through one valve device, such as keeping the high temperature of the coolant for a certain portion of the engine and keeping the low temperature of the coolant for other portion low is applied.

When the coolant temperature rises in the engine, the thermostat opens and the coolant circulates to the radiator. In the instant case, since the radiator coolant temperature is a low temperature, a sudden change (a coolant over/under shoot and hunting) of the coolant temperature occurs.

In the instant case, since the coolant temperature change is large by a head and a block inside the engine and the radiator, a heater core, an oil cooler, an exhaust gas recirculation (EGR) cooler, etc., the engine receives a thermal shock such that a durability may be deteriorated.

Such a phenomenon is similar problem in a multi-stage control water pump, in which the coolant temperature change is suddenly generated when a slider opens and then the coolant is circulated.

FIG. 8 is a graph showing a temperature of an engine including a conventional multi-stage control coolant pump and a coolant temperature.

FIG. 8 shows a metal surface temperature of a head and a block and a coolant temperature of a case that an intermittent flow stoppage and an always flow flowing by the multi-stage control coolant pump are applied.

In the graph, in the case of the intermittent flow stoppage, it may be confirmed that many temperature differences occur such that the thermal shock occurs severely.

In the case that the water pump is always operated, the metal surface temperature of the head and the block and the coolant temperature are stably increased, however there is a problem that the warm-up time is delayed The information disclosed in the present Background of the Invention section is only for enhancement of understanding of the general background of the invention and may not be taken as an acknowledgement or any form of suggestion that the present information forms the prior art already known to a person skilled in the art.

BRIEF SUMMARY

Various aspects of the present invention are directed to providing a coolant pump and a cooling system including the same for a vehicle for reducing a warm-up time of the engine and preventing a thermal shock.

A coolant pump for a vehicle according to an exemplary embodiment of the present invention may include an impeller mounted at one side of a shaft and pumping a coolant; a pulley mounted at the other side of the shaft and receiving a torque; a coolant pump housing including an inlet to which the coolant inflows and a discharge port formed in a vertical to the shaft; a slider disposed to be movable in a longitudinal direction of the shaft to selectively block or open the discharge port; and a driver moving the slider, wherein a fine passage that the coolant is expelled to the discharge port is formed at the slider.

The slider may include a vertical portion formed in a vertical direction of the shaft; and a block portion formed to be bent at the vertical portion and selectively blocking the discharge port, and the fine passage is formed at the block portion.

The fine passage may be a groove formed at one end portion of the block portion.

A pump housing groove may be formed at the portion of the pump housing in contact with the block portion, a fine protrusion portion may be formed at the block portion, and the fine passage may be formed between the fine protrusion portion and the pump housing groove.

The fine passage may be a hole formed at one side of the block portion.

The fine passage may be formed in plural.

The driver may include a coolant transmitting portion transmitting a coolant transmitted through the inlet; a control device exhausting the coolant transmitted from the coolant transmitting portion to an outside or again transmitting the coolant to the coolant pump; and a control chamber formed by the slider and the coolant pump housing and moving the slider according to the transmission of the coolant from the control device.

The coolant pump for the vehicle according to an exemplary embodiment of the present invention may further include a return elastic portion provided between the slider and the impeller to elastically support the slider.

The coolant pump for the vehicle according to an exemplary embodiment of the present invention may further include a supporting member provided between the slider and the impeller to support the return elastic portion.

The control device may include a check valve preventing the coolant transmitted from the coolant transmitting portion from being returned to the coolant transmitting portion, a solenoid opening or closing the check valve and a controller configured for controlling an operation of the solenoid.

A cooling system of a vehicle according to an exemplary embodiment of the present invention may include a cylinder block; a cylinder head coupled with the cylinder block; and a coolant pump for a vehicle supplying a coolant to the cylinder block and the cylinder head, wherein the coolant pump for the vehicle may include an impeller mounted at one side of a shaft and pumping the coolant; a pulley mounted at the other side of the shaft and receiving a torque; a coolant pump housing including an inlet to which the coolant inflows and a discharge port formed in a vertical to the shaft; a slider disposed to be movable in a longitudinal direction of the shaft to selectively block or open the discharge port; and a driver moving the slider, and a fine passage that the coolant is expelled to the discharge port is formed at the slider.

The slider may include a vertical portion formed in a vertical direction of the shaft; and a block portion formed to be bent at the vertical portion and selectively blocking the discharge port, and the fine passage may be formed at the block portion.

The fine passage may be a groove formed at one end portion of the block portion.

A pump housing groove may be formed at the portion of the pump housing in contact with the block portion, a fine protrusion portion may be formed at the block portion, and the fine passage may be formed between the fine protrusion portion and the pump housing groove.

The fine passage may be a hole formed at one side of the block portion.

The fine passage may be formed in plural.

The driver may include a coolant transmitting portion transmitting a coolant transmitted through the inlet; a control device exhausting the coolant transmitted from the coolant transmitting portion to an outside or again transmitting the coolant to the coolant pump; and a control chamber formed by the slider and the coolant pump housing and moving the slider according to the transmission of the coolant from the control device.

A cooling system for a vehicle according to an exemplary embodiment of the present invention may further include a return elastic portion provided between the slider and the impeller to elastically support the slider.

A cooling system for a vehicle according to an exemplary embodiment of the present invention may further include a supporting member provided between the slider and the impeller to support the return elastic portion.

The control device may include a check valve preventing the coolant transmitted from the coolant transmitting portion from being returned to the coolant transmitting portion, a solenoid opening or closing the check valve and a controller configured for controlling an operation of the solenoid.

The coolant pump and the cooling system including the same according to an exemplary embodiment of the present invention may reduce the warm-up time of the engine and may prevent the thermal shock by respectively controlling the coolant supplied to the cylinder block and cylinder head according to the driving condition.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
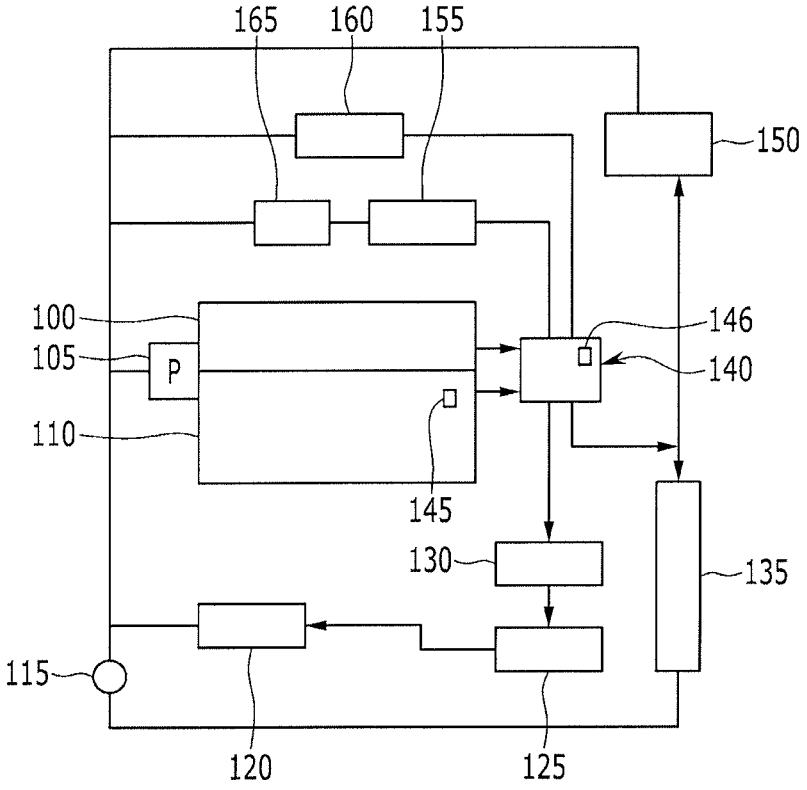
FIG. 1 is a schematic diagram of a cooling system including a coolant pump according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, various exemplary embodiments of the present invention will be described with reference to the accompanying drawings.

The sizes and thicknesses of the configurations shown in the drawings are provided selectively for the convenience of description, such that the present invention is not limited to those shown in the drawings and the thicknesses are exaggerated to make some parts and regions clear.

However, parts irrelevant to the description will be omitted to clearly describe the exemplary embodiments of the present invention, and the same or similar constituent elements will be designated by the same reference numerals throughout the specification.

In the following description, names of constituent elements are classified as a first . . . , a second . . . , and the like to discriminate the constituent elements having the same name, and the names are not necessarily limited to the order.

FIG. 1 is a schematic diagram of a cooling system including a coolant pump according to an exemplary embodiment of the present invention.

Referring to FIG. 1, a cooling system according to an exemplary embodiment of the present invention may include a cylinder block 110, a cylinder head 100, a coolant pump 105, a coolant control module 140, a low pressure EGR cooler 155, a heater core 165, an EGR valve 160, a reservoir tank 150, a radiator 135, a transmission oil warmer 130, an oil cooler 125, a high pressure EGR cooler 120, and a thermostat 115.

The coolant pump 105 is disposed at a coolant entrance side of the cylinder block 110, and the coolant control module 140 is disposed at a coolant outlet side of the cylinder block 110.

The coolant control module 140 may control the coolant passing through the low pressure EGR cooler 155 and the heater core 165, may control the coolant passing through the EGR valve 160, may control the coolant passing through the radiator 135, and may control the coolant passing through the transmission oil warmer 130 and the oil cooler 125.

The coolant control module 140 may be a flow rate control configuration of mechanical or electronic various shapes.

The reservoir tank 150 is connected to the coolant line connected into the radiator 135, and the coolant of the reservoir tank 150 is connected into the intake side of the coolant pump 105. Also, the thermostat 115 is opened or closed depending on a coolant temperature, a disposition location may be changed depending on a design specification, and in an exemplary embodiment of the presently claimed invention, it may not be installed.

A coolant temperature sensor 145 detecting a temperature of the coolant passing through the cylinder block 110 is disposed, and a coolant temperature sensor 146 detecting a temperature of the coolant passing through the coolant control module 140 is disposed.

In an exemplary embodiment of the present invention, a structure in which the coolant control module 140 distributes the coolant to coolant parts, etc. is not limited to the drawing, and numerous variations are possible. Also, a structure and a function of the coolant parts (such as a heater core and a radiator) are obvious to ordinary technicians in the technical fields, so repeated explanations are omitted.

The coolant pump 105 pumps the coolant exhausted from the coolant parts. Also, the coolant pump 105 may control the coolant pumped into the cylinder head 100 and the cylinder block 110 depending on a rotation speed (RPM), a driving load (a fuel injection rate, etc.), a coolant temperature, etc. of the engine.

The structure of the coolant pump 105 is described with reference to FIG. 2.

Figure 2:
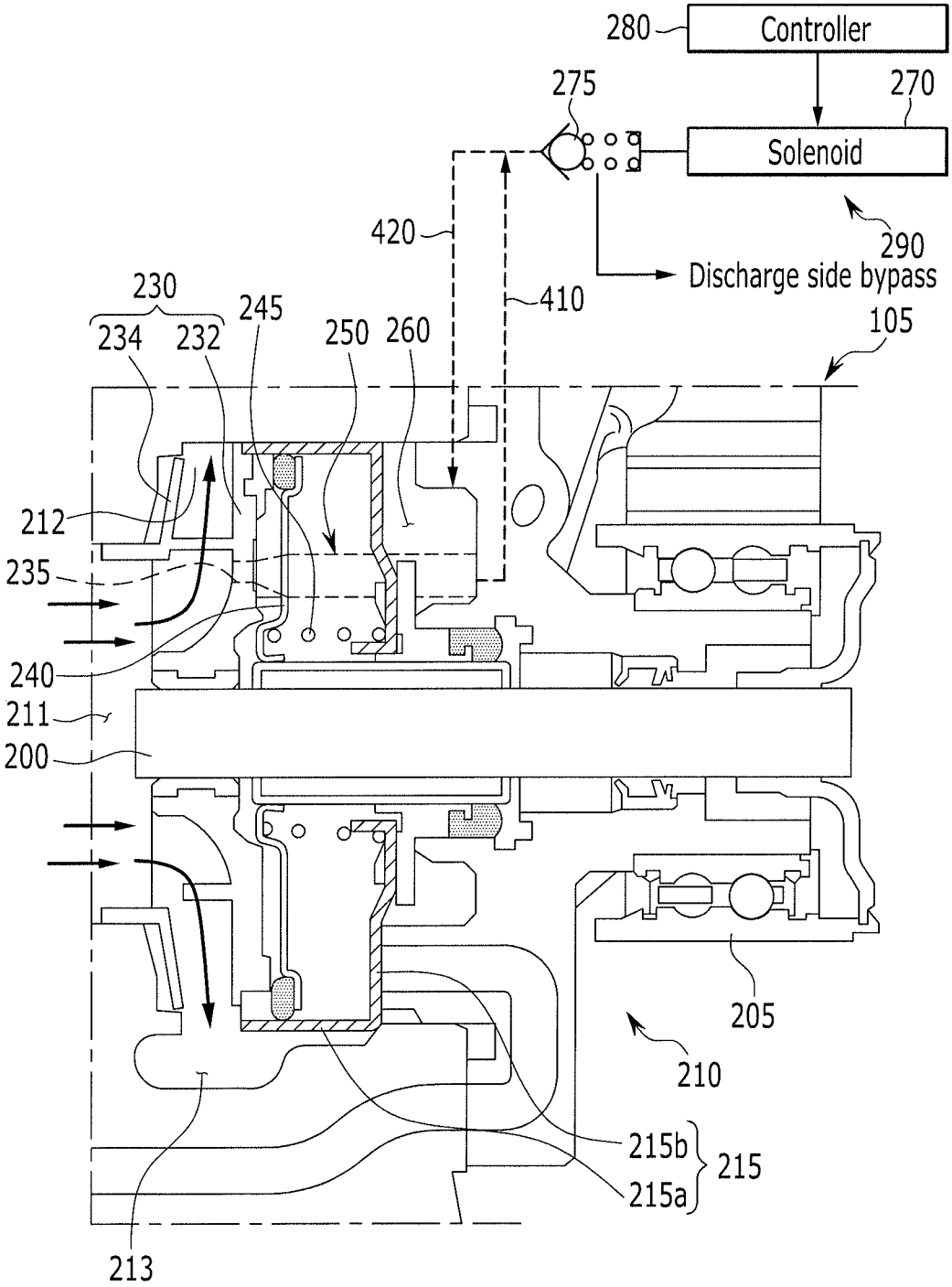
FIG. 2 and FIG. 3 are cross-sectional views showing a coolant pump according to an exemplary embodiment of the present invention.
Figure 3:
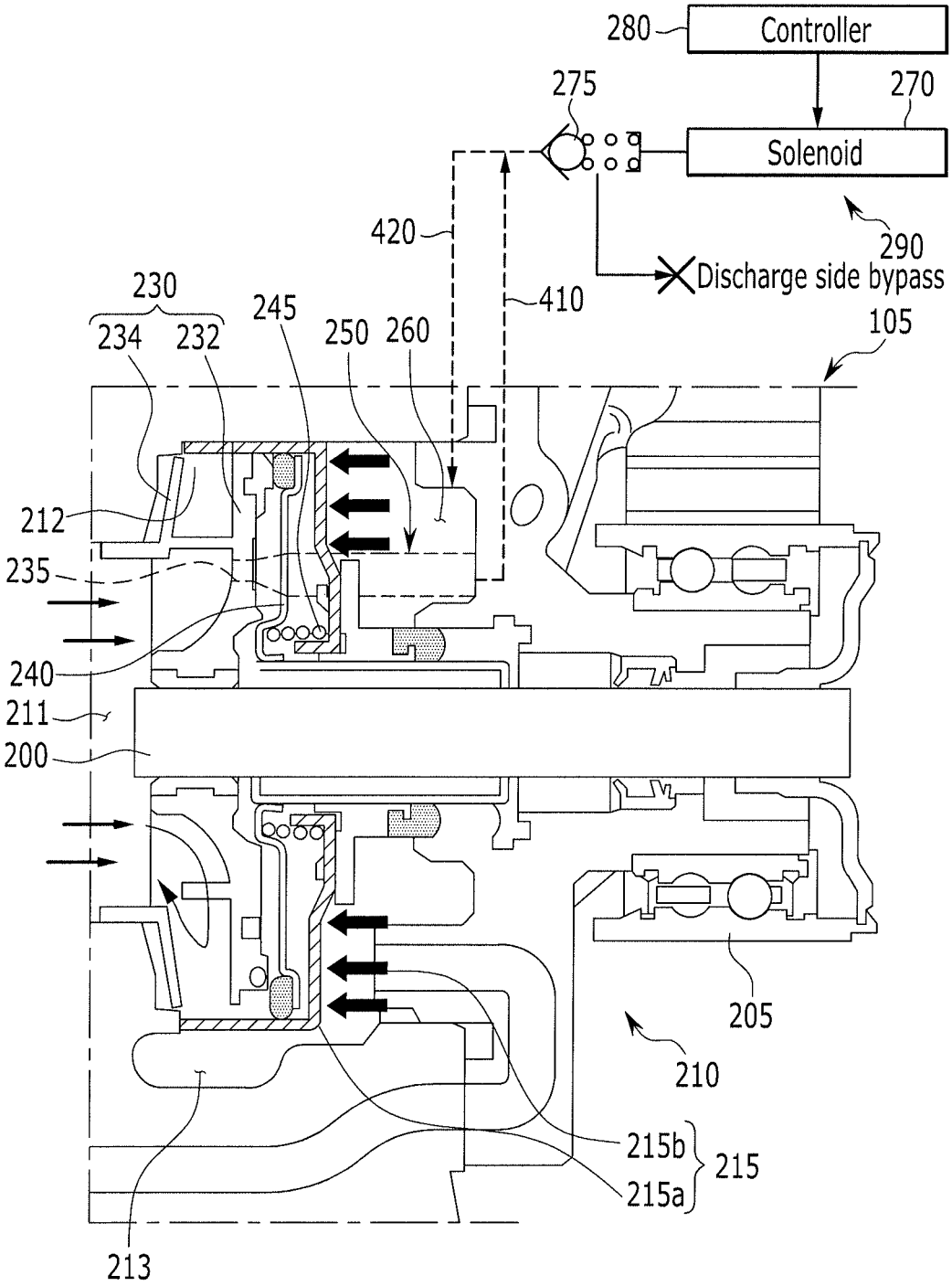

FIG. 2 and FIG. 3 are cross-sectional views showing a coolant pump according to an exemplary embodiment of the present invention.

Referring to FIG. 2 and FIG. 3, the coolant pump for the vehicle according to an exemplary embodiment of the present invention includes an impeller 230 mounted at one side of the shaft 200 and pumping the coolant, a pulley 205 mounted at the other side of the shaft 200 and receiving a torque, a coolant pump housing 210 including an inlet 211 into which the coolant inflows and discharge ports 212 and 213 formed in a direction vertical to the shaft 200, a slider 215 disposed to be movable in a longitudinal direction of the shaft 200 to selectively block and open the discharge ports 212 and 213, and a driver moving the slider.

The discharge ports 212 and 213 communicate with the cylinder block 110, or the cylinder block 110 and the cylinder head 100, and supplies the coolant to the cylinder block 110, or the cylinder block 110 and the cylinder head 100 if the discharge ports 212 and 213 are opened.

The pulley 205 is mounted on one end portion of the shaft 200, and the pulley 205 receives a torque from an output shaft of the engine to rotate the shaft 200.

The impeller 230 is mounted on an external circumference of the shaft 200 and includes a rotation disk 232 of a disk shape and a wing 234 formed at one surface of the rotation disk 232.

The driver includes a coolant transmitting portion 250 transmitting the coolant transmitted through the inlet 211, a control device 290 exhausting the coolant transmitted from the coolant transmitting portion 250 to the outside or again transmitting the coolant to the coolant pump 105, and a control chamber 260 formed by the slider 215 and the coolant pump housing 210 and moving the slider 215 depending on the transmission of the coolant from the control device 290.

A coolant transmission hole 235 may be formed at the coolant pump housing 210 to communicate the inlet 211 and the coolant transmitting portion 250.

A return elastic portion 245 is provided between the slider 215 and the impeller 230 to elastically support the slider 215 and a supporting member 240 may be provided between the slider 215 and the impeller 230 to support the return elastic portion 245.

The control device 290 includes a check valve 275 preventing the coolant transmitted from the coolant transmitting portion from being returned to the coolant transmitting portion or reduce the amount of the coolant transmitted from the coolant transmitting portion to the coolant transmitting portion, a solenoid 270 opening or closing the check valve 275, and a controller 280 controlling the operation of the solenoid 270.

In an exemplary embodiment of the presently claimed invention, a first passage 410 is connected to the coolant transmitting portion 250 and the check valve 295 and a second passage 420 is connected to the control chamber and the check valve 295.

The first passage 410 and the second passage 40 are connected to the check valve 295 in parallel.

The slider 215 includes a vertical portion 215*b* formed in a vertical direction of the shaft 200 and a block portion 215*a* formed to be curved from the vertical portion 215*b* to selectively block the discharge ports 212 and 213.

FIG. 4, FIG. 5, FIG. 6 and FIG. 7 are views showing a slider of a coolant pump according to an exemplary embodiment of the present invention.

Figure 4:
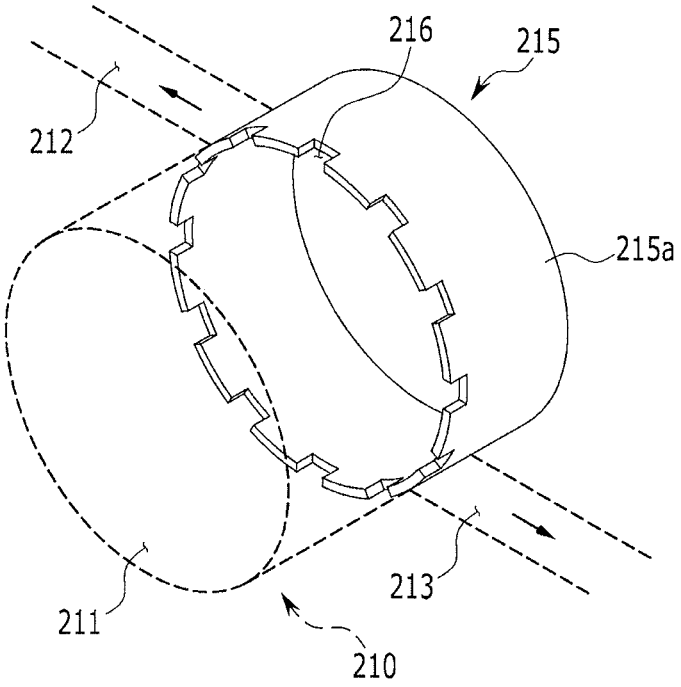
FIG. 4, FIG. 5, FIG. 6 and FIG. 7 are views showing a slider of a coolant pump according to an exemplary embodiment of the present invention.
Figure 5:
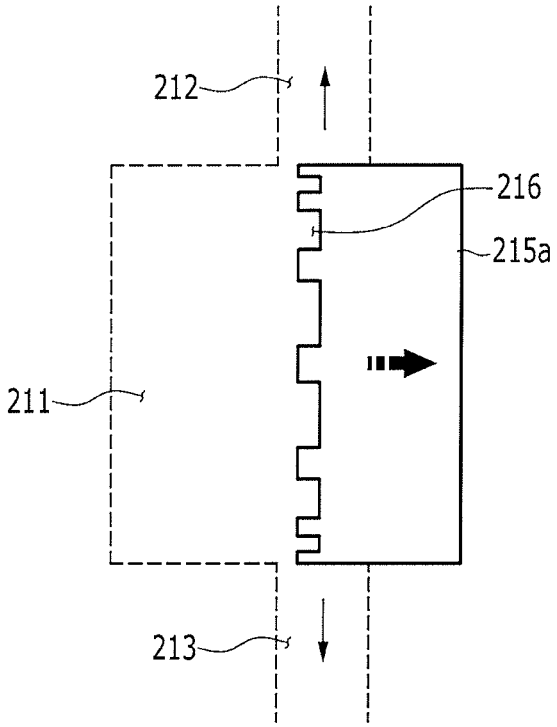

Referring to FIG. 4 and FIG. 5, a fine passage 216 to which the coolant is expelled to the discharge ports 212 and 213 may be formed at the slider 215. Also, the fine passage 216 may be formed at the block portion 215*a*.

Next, the operation of the coolant pump for the vehicle according to an exemplary embodiment of the present invention is described with reference to FIG. 2 to FIG. 5.

In the state that the pulley 205 is rotated, the portion of the coolant transmitted to the inlet 211 is transmitted to the check valve 275 through the coolant transmission hole 235 and the coolant transmitting portion 250.

The controller 280 determines an opening rate of the slider 215 based on a measuring signal of a vehicle operation state including signals of the coolant temperature sensor, the outdoor temperature sensor, etc., and outputs the signal corresponding to the opening rate to the solenoid 270, the check valve 275 is opened or closed depending on the operation of the solenoid 270.

As shown in FIG. 2, if the check valve 275 is opened, the coolant transmitted through the coolant transmitting portion 250 bypasses to the discharge side, the slider 215 moves backward by the elastic force of the return elastic portion 245, that is, moves to the right in the drawing, and the coolant is supplied to the cylinder block 110, or the cylinder block 110 and the cylinder head 100 through the discharge ports 212 and 213.

As shown in FIG. 3, if the check valve 275 is closed, the coolant transmitted through the coolant transmitting portion 250 is transmitted to the control chamber 260 through the first passage 410 and the second passage 40, the slider 215 moves forward by the coolant pressure in the control chamber, that is, moves to the left in the drawing and closes the discharge ports 212 and 213.

Figure 8:
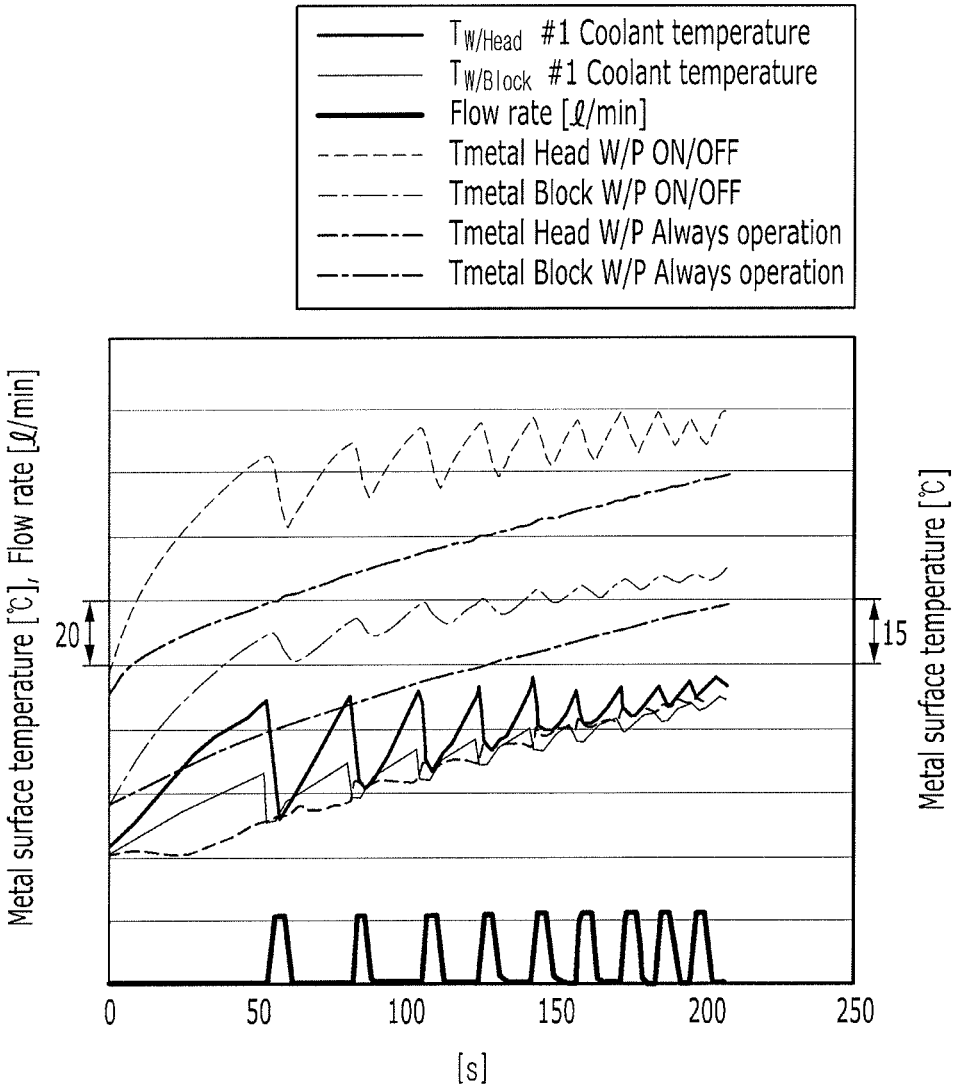
FIG. 8 is a graph showing a temperature of an engine including a conventional multi-stage control coolant pump and a coolant temperature.

Incidentally, as shown in FIG. 8, during the operation of the coolant pump 105, the sudden temperature change of the coolant temperature and the metal surface of the cylinder block 110 and the cylinder head 100 may be generated by the sudden change of the coolant flow rate.

However, as shown in FIG. 5, when the slider 215 is opened or closed through the fine passage 216 of the coolant pump for the vehicle according to an exemplary embodiment of the present invention, the slight amount of the coolant may be first discharged such that the sudden change of the coolant flow rate may be prevented. Accordingly, the sudden temperature change of the metal surface of the cylinder block 110 and the cylinder head 100 may be suppressed.

As shown in FIG. 4 and FIG. 5, the fine passage may be a groove 216 formed at one end portion of the block portion.

Figure 6:
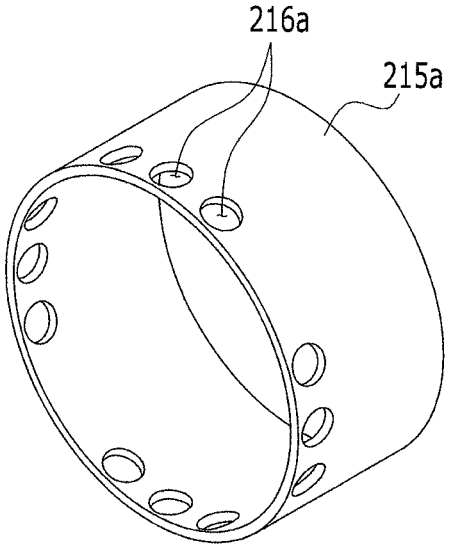

As shown in FIG. 6, the fine passage may be a hole 216*a* formed at one side of the block portion.

Figure 7:
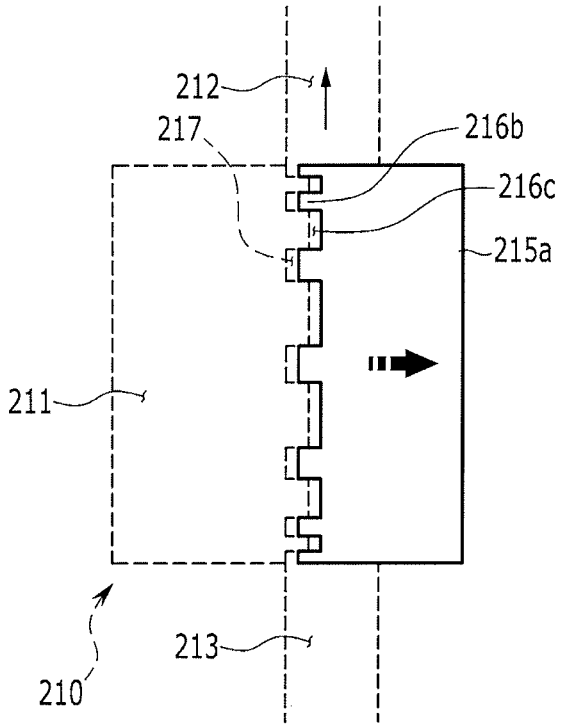

Also, as shown in FIG. 7, a pump housing groove (a groove; 217) may be formed at the portion of the pump housing in contact with the block portion, a fine protrusion portion 216*b* may be formed at the block portion 215*a*, and the fine passage 216*c* may be formed between the fine protrusion portion 216*b* and the pump housing groove 217.

The fine passage may be formed in plural.

The coolant pump and the cooling system including the same according to an exemplary embodiment of the present invention may reduce the warm-up time of the engine and may prevent the thermal shock by respectively controlling the coolant supplied to the cylinder block and cylinder head according to the driving condition.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A coolant pump apparatus for a vehicle, the coolant pump apparatus comprising:

an impeller mounted at a first side of a shaft and pumping a coolant;

a pulley mounted at a second side of the shaft and receiving a torque;

a coolant pump housing including an inlet through which the coolant inflows and a discharge port through which the coolant is discharged;

a slider slidably disposed on the shaft to be selectively movable in a longitudinal direction of the shaft to block or open the discharge port; and a driver selectively moving the slider, wherein a passage through which the coolant is expelled to the discharge port is formed in the slide, and wherein the slider includes:

a vertical portion formed in a vertical direction of the shaft; and a block portion formed to be bent at the vertical portion and selectively blocking the discharge port according to operation of the driver, wherein the passage is formed at the block portion.

2. The coolant pump apparatus for the vehicle of claim 1, wherein the passage is a groove formed at an end portion of the block portion.

3. The coolant pump apparatus for the vehicle of claim 1, wherein a pump housing groove is formed at a portion of the pump housing in contact with the block portion, wherein a protrusion portion is formed at the block portion, and wherein the passage is formed between the protrusion portion and the pump housing groove.

4. The coolant pump apparatus for the vehicle of claim 1, wherein the passage is a hole formed at a side of the block portion.

5. The coolant pump apparatus for the vehicle of claim 1, wherein the passage is formed in plural.

6. The coolant pump apparatus for the vehicle of claim 1, wherein the driver includes:

a coolant transmitting portion connected to a coolant transmission hole formed in the impeller and transmitting the coolant transmitted through the inlet which is fluidically connected to the coolant transmission hole;

a control device connected to the coolant transmitting portion and configured for exhausting the coolant transmitted from the coolant transmitting portion to an outside or transmitting the coolant to the coolant pump apparatus; and a control chamber formed between the slider and the coolant pump housing and moving the slider by to a coolant transmitted from the control device.

7. The coolant pump apparatus for the vehicle of claim 6, further including:

a return elastic portion mounted between the slider and the impeller to elastically support the slider.

8. The coolant pump apparatus for the vehicle of claim 7, further including:

a supporting member mounted between the slider and the impeller to support the return elastic portion.

9. The coolant pump apparatus for the vehicle of claim 6, wherein the control device includes:

a check valve fluidically connected to the coolant transmitting portion through a first passage and fluidically connected to the control chamber through a second passage and selectively exhausting the coolant transmitted from the coolant transmitting portion to an outside or transmitting the coolant to the control chamber of the coolant pump apparatus through the second passage;

a solenoid engaged to the check valve and selectively opening the check valve; and a controller engaged to the solenoid and configured for controlling an operation of the solenoid.

10. A coolant system for a vehicle, the system comprising:

a cylinder block;

a cylinder head coupled with the cylinder block; and a coolant pump apparatus connected to the cylinder block and the cylinder head and supplying a coolant to the cylinder block and the cylinder head, wherein the coolant pump apparatus for the vehicle includes:

an impeller mounted at a first side of a shaft and pumping the coolant;

a pulley mounted at a second side of the shaft and receiving a torque;

a coolant pump housing including an inlet through which the coolant inflows and a discharge port through which the coolant is discharged;

a slider slidably disposed on the shaft to be selectively movable in a longitudinal direction of the shaft to block or open the discharge port; and a driver selectively moving the slider, and a passage through which the coolant is expelled to the discharge port is formed in the slider, wherein the slider includes:

a vertical portion formed in a vertical direction of the shaft; and a block portion formed to be bent at the vertical portion and selectively blocking the discharge port according to operation of the driver, and the passage is formed at the block portion.

11. The coolant system for the vehicle of claim 10, wherein the passage is a groove formed at an end portion of the block portion.

12. The coolant system for the vehicle of claim 10, wherein a pump housing groove is formed at a portion of the pump housing in contact with the block portion, wherein a protrusion portion is formed at the block portion, and wherein the passage is formed between the protrusion portion and the pump housing groove.

13. The coolant system for the vehicle of claim 10, wherein the passage is a hole formed at a side of the block portion.

14. The coolant system for the vehicle of claim 10, wherein the passage is formed in plural.

15. The coolant system for the vehicle of claim 10, wherein the driver includes:

a coolant transmitting portion connected to a coolant transmission hole formed in the impeller and transmitting the coolant transmitted through the inlet fluidically connected to the coolant transmission hole;

a control device connected to the coolant transmitting portion and configured for exhausting the coolant transmitted from the coolant transmitting portion to an outside or transmitting the coolant to the coolant pump apparatus; and a control chamber formed between the slider and the coolant pump housing and moving the slider by the coolant transmitted from the control device.

16. The coolant system for the vehicle of claim 15, further including:

a return elastic portion mounted between the slider and the impeller to elastically support the slider.

17. The coolant system for the vehicle of claim 16, further including:

a supporting member mounted between the slider and the impeller to support the return elastic portion.

18. The coolant system for the vehicle of claim 15, wherein the control device includes:

a check valve fluidically connected to the coolant transmitting portion through a first passage and fluidically connected to the control chamber through a second passage and selectively exhausting the coolant transmitted from the coolant transmitting portion to an outside or transmitting the coolant to the control chamber of the coolant pump apparatus through the second passage; and and a solenoid engaged to the check valve and selectively opening the check valve.

* * * * *